11/18/80 XR 4,234,637

United States Patent [19]

Sewell et al.

[11] 4,234,637

[45] Nov. 18, 1980

[54] MICROPOROUS PROTECTIVE COVERINGS

[75] Inventors: Richard B. H. Sewell; Derek J. Kidd, both of Victoria, Canada

[73] Assignee: Her Majesty the Queen in right of Canada, as represented by the Minister of National Defence, Ottawa, Canada

[21] Appl. No.: 50,297

[22] Filed: Jun. 20, 1979

[30] Foreign Application Priority Data

Jun. 22, 1978 [CA] Canada ..... 306049

[51] Int. Cl.[3] ..... B32B 3/26

[52] U.S. Cl. ..... 428/131; 2/2.1 R; 156/252; 156/272; 219/121 LM; 428/134; 428/338; 428/339

[58] Field of Search ..... 219/121 LM, 121 L, 384; 346/76 L; 156/272, 252; 428/131-136, 332, 338, 339; 2/2.1 R, 67, 82, DIG. 1, DIG. 5

[56] References Cited

U.S. PATENT DOCUMENTS

| | | | |
|---|---|---|---|
| 3,226,527 | 12/1965 | Harding | 219/384 |
| 3,594,261 | 7/1971 | Broerman | 219/121 LM |
| 3,695,988 | 10/1972 | Steigerwald | 428/131 |
| 3,725,190 | 4/1973 | Bostick | 428/339 |
| 3,770,560 | 11/1973 | Elder | 428/131 |
| 4,032,743 | 6/1977 | Erbach et al. | 219/384 |

*Primary Examiner*—William J. Van Balen

*Attorney, Agent, or Firm*—Cushman, Darby & Cushman

[57] ABSTRACT

A flexible, microporous, non-water soluble, non-skin-toxic film is provided for use in protective garments such as diver's suits, foul weather suits and the like. The film is of a thickness in the range of about 12.5μ to 12.5 mm and possesses about 100 to 1000 pores of a diameter in the range of about 2 to 100μ per $cm^2$ of film surface. The porosity of the film permits the passage of body vapors but prevents, at least up to modest external pressures, the counter-passage of water. The film can be of a foamed material to provide increased insulational value.

2 Claims, No Drawings

MICROPOROUS PROTECTIVE COVERINGS

BACKGROUND OF THE INVENTION

The present invention relates to a flexible, microporous, non-water soluble, non-skin-toxic film for use in protective garments such as diver's suits, foul weather suits and the like. The porosity of the film permits the passage of body vapours but prevents, at least up to modest external pressures, the counter-passage of water.

Protective garments such as the neoprene foam wet suits used widely in scuba diving do not permit any significant passage of body vapours, with the result that the suits cannot be worn comfortably out of water for anything more than short periods of time because of a buildup of perspiration.

Similarly, conventional foul weather suits such as rain suits, which incorporate some form of impermeable barrier material, for example in the form of a rubber lining, cannot comfortably be worn for extended periods of time during warm and/or stress producing conditions because body vapours accumulate within the confines of the garment and soak all clothing worn under the barreir material.

SUMMARY OF THE INVENTION

It is an object of the present invention to provide a flexible microporous, non-water soluble, non-skin-toxic film for use in protective garments such as diver's suits, foul weather suits and the like which permits the passage of body vapours but which prevents, at least up to modest external pressures, the counter-passage of water.

It is a further object of the present invention to provide a method of making a flexible, microporous, non-water soluble, non-skin-toxic film for use in protective garments such as diver's suits, foul weather suits and the like which permits the passage of body vapours but which prevents, at least up to modest external pressures, the counter-passage of water.

In one particular aspect the present invention provides a flexible, microporous, non-water soluble, non-skin-toxic film for use in protective garments, said film having first and second surfaces, a thickness between said surfaces in the range of about 12.5$\mu$ to 12.5 mm, and between about 100 to 1000 pores per cm$^2$ of film surface, said pores extending between said surfaces and having a diameter in the range of about 2 to 100$\mu$.

In another particular aspect the present invention provides a method of making a flexible, microporous, non-water soluble, non-skin-toxic film for use in protective garments, said film having first and second surfaces, a thickness between said surfaces in the range of about 12.5$\mu$ to 12.5 mm, and between about 100 to 1000 pores per cm$^2$ of film surface, said pores extending between said surfaces and having a diameter in the range of about 2 to 100$\mu$ comprising moving a flexible, non-water soluble, non-skin-toxic film having a thickness in the range of about 12.5$\mu$ to 12.5 mm past a line of laser sources of selected rod diameter, spacing and repetition rate at a speed to produce the desired microporosity.

DESCRIPTION OF THE PREFERRED EMBODIMENTS

The flexible, microporous film of the present invention can be fashioned into protective garments such as diver's suits and foul weather suits which are comfortable to wear regardless of the surrounding environment. The film is non-water soluble and non-skin-toxic and may be worn as a primary garment or as a covering over other clothing.

Garments fashioned from the film of the present invention are comfortable to wear regardless of the surrounding environment due to the property of the film of permitting the passage of body vapours through the film to the surrounding environment while preventing at least up to modest external pressures, the counter-passage of water. This property is attributable to the microporosity of the film. The film contains between about 100 to 1000 pores per cm$^2$ of film surface, the pores extending completely through the film and having a diameter in the range of about 2 to 100$\mu$. It is preferred that the pores be tapered such that they have an average diameter at one surface of the film of about 2$\mu$ and an average diameter at the other surface of the film in the range of about 30 to 100$\mu$. The surface having the smaller average pore diameters is intended for use as the outer surface of garments fashioned from the film.

The flexible, microporous film of the invention is typically comprised of natural or synthetic elastomeric or synthetic polymeric materials. The materials can be foamed to provide better insulational value. The thickness of the film is typically in the range of about 12.5$\mu$ to 12.5 mm.

The film of the invention may be fashioned into garments such as diver's suits or foul weather suits by cutting appropriately shaped panels out of a sheet of the film and thereafter attaching the panels together in a desired configuration by conventional means such as glueing, heat-welding and the like.

The flexible, microporous film of the invention, when fashioned into a diver's suit akin to a conventional neoprene foam wetsuit, can be comforably worn out of the water because of the property of the film to permit the passage through the film to the surrounding environment of body vapours which, otherwise, would accumulate as perspiration. In the water, suits comprised of the film of the present invention act much in the same manner as a conventional wetsuit in that the pores will fill with water due to the surrounding water pressure, but the water will be essentially static and will become warmed by body heat in the same manner as the water trapped in a neoprene foam wetsuit.

When the flexible, microporous film of the invention is used in foul weather suits such as rain suits the microporosity similariy permits the passage of body vapours to the surrounding environment but prevents, at least at normal external pressures, any counter-passage of water. Wearer comfort is thus assured by preventing undue soaking of clothing worn under the suit by trapped perspiration.

In some instances, for example when the film is used for survival/immersion suits in harsh environments, it is desirable that the film thickness of the garment portions protecting critical body heat loss areas be greater than the thickness of other portions of the garment. This of course can be readily accomplished during garment manufacture by using film of increased thickness, compared to the film employed for the remainder of the garment, for the panel or panels intended to cover critical body heat loss areas such as the groin, chest and neck.

The film of the invention can be prepared by moving a flexible, non-water soluble, non-skin-toxic film having a thickness in the range of about 12.5μ to 12.5 mm past a line of laser sources of selected rod diameter, spacing and repetition rate at a passage speed appropriate to produce the desired microporosity. The film is typically moved past the line of laser sources in a direction normal to the line of the laser sources.

Other modifications and variations falling within the true broad spirit and scope of the invention will be obvious to those skilled in the art.

The embodiments of the invention in which an exclusive property or privilege is claimed are defined as follows:

1. A flexible, microporous non-water-soluble, non-skin-toxic film of a material selected from the group consisting of natural and synthetic elastomers and synthetic polymers for use in protective garments, said film having first and second surfaces, a thickness between said surfaces being in the range of about 12.5μ to 12 mm, and between about 100 to 1000 pores per $cm^2$ of film surface, said pores extending between said surfaces and having a diameter in the range of about 2 to 100μ, wherein the pores are tapered and have an average diameter at the first surface of the film of about 2μ and an average diameter at the second surface of the film in the range of about 30 to 100μ.

2. A microporous film according to claim 1, wherein the film is of foamed material.

* * * * *